US007674016B2

(12) United States Patent
Zhang et al.

(10) Patent No.: US 7,674,016 B2
(45) Date of Patent: Mar. 9, 2010

(54) LED LAMP WITH A HEAT DISSIPATION DEVICE

(75) Inventors: Wen-Xiang Zhang, Shenzhen (CN); Guang Yu, Shenzhen (CN); Li He, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 202 days.

(21) Appl. No.: 11/836,722

(22) Filed: Aug. 9, 2007

(65) Prior Publication Data

US 2009/0040776 A1 Feb. 12, 2009

(51) Int. Cl.
*F21V 29/00* (2006.01)

(52) U.S. Cl. ..... 362/294; 362/373; 362/800

(58) Field of Classification Search ..... 362/294, 362/373, 800; 165/183
See application file for complete search history.

(56) References Cited

U.S. PATENT DOCUMENTS 7,374,316 B2 * 5/2008 Kuo et al. ..... 362/373
7,461,951 B2 * 12/2008 Chou et al. ..... 362/294
7,500,515 B2 * 3/2009 Tsuji et al. ..... 165/173

FOREIGN PATENT DOCUMENTS

CN 2851822 Y 12/2006

* cited by examiner

*Primary Examiner*—Jong-Suk (James) Lee
*Assistant Examiner*—Mark Tsidulko
(74) *Attorney, Agent, or Firm*—Frank R. Niranjan

(57) ABSTRACT

An LED lamp includes a heat sink (10) and a plurality of LED modules (20) mounted on a periphery of the heat sink. The heat sink defines a through hole (122) from a lateral side to an opposite lateral side thereof to define a cylindrical inner face. A plurality of fins (16) are attached to the heat sink in a manner such that the fins have spaced external portions (160) extending outwardly from the periphery of the heat sink, and opposite internal portions (162) extending inwardly from the inner face of the heat sink. The internal portions connect with each other to form a joint (164) in the through hole, thus increasing a heat dissipating area of the heat sink and reinforcing the heat sink.

16 Claims, 4 Drawing Sheets

LED LAMP WITH A HEAT DISSIPATION DEVICE

BACKGROUND OF THE INVENTION

1. Field of the Invention

The present invention relates to a light emitting diode (LED) lamp, and more particularly to an LED lamp incorporating a heat dissipation device for improving heat dissipation of the LED lamp.

2. Description of Related Art

LED (light emitting diode) lights are highly energy efficient electrical light sources, and are increasingly being considered for indoor and outdoor lighting purposes. In order to increase the overall lighting brightness, a plurality of LEDs are often incorporated into a signal lamp; however, this can lead to a significant problem of over-heating.

Conventionally, an LED lamp comprises a cylindrical enclosure functioning as a heat sink and a plurality of LEDs mounted on an outer wall of the enclosure. The LEDs are arranged in a plurality of lines along a lateral side of the enclosure and around the enclosure. The enclosure is open at one end. When the LEDs are activated, heat generated by the LEDs is dispersed to ambient air via the enclosure by natural air convection.

However, in order to achieve a required heat dissipation efficiency, the enclosure should be made large enough to obtain a sufficient heat dissipating area, whereby a volume of the LED lamp becomes huge correspondingly, which makes a transportation of the LED lamp inconvenient. Furthermore, the large enclosure makes the lamp heavy and bulky, which is not preferred in view of a present trend of compact electronic gadget.

What is needed, therefore, is an LED lamp which can overcome the above-mentioned disadvantage.

SUMMARY OF THE INVENTION

An LED lamp includes a heat sink and a plurality of LED modules mounted on a periphery of the heat sink. The heat sink defines a through hole from a lateral side to an opposite lateral side thereof to define a cylindrical inner face. A plurality of fins are attached to the heat sink in a manner such that the fins have spaced external portions extending outwardly from the periphery of the heat sink, and opposite internal portions extending inwardly from the inner face of the heat sink. The internal portions connect with each other to form a joint in the through hole, thus increasing a heat dissipating area of the heat sink and reinforcing the heat sink.

Other advantages and novel features of the present invention will become more apparent from the following detailed description when taken in conjunction with the accompanying drawings, in which:

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE INVENTION

Figure 1:
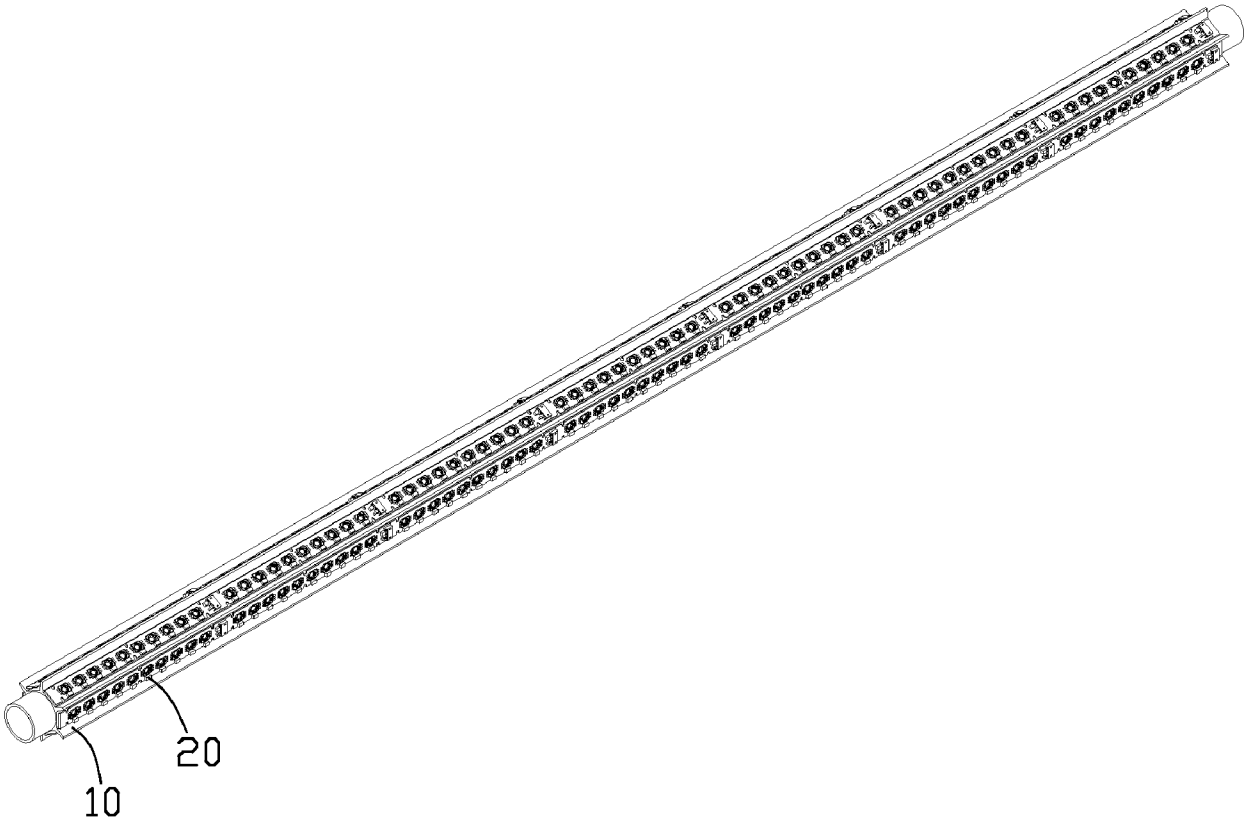
FIG. 1 is an assembled, isometric view of an LED lamp with a heat dissipation device in accordance with a preferred embodiment of the present invention.

Referring to FIG. 1, an LED lamp adapted for a lighting purpose comprises a heat sink 10 and a plurality of LED modules 20 mounted on a periphery of the heat sink 10.

Figure 2:
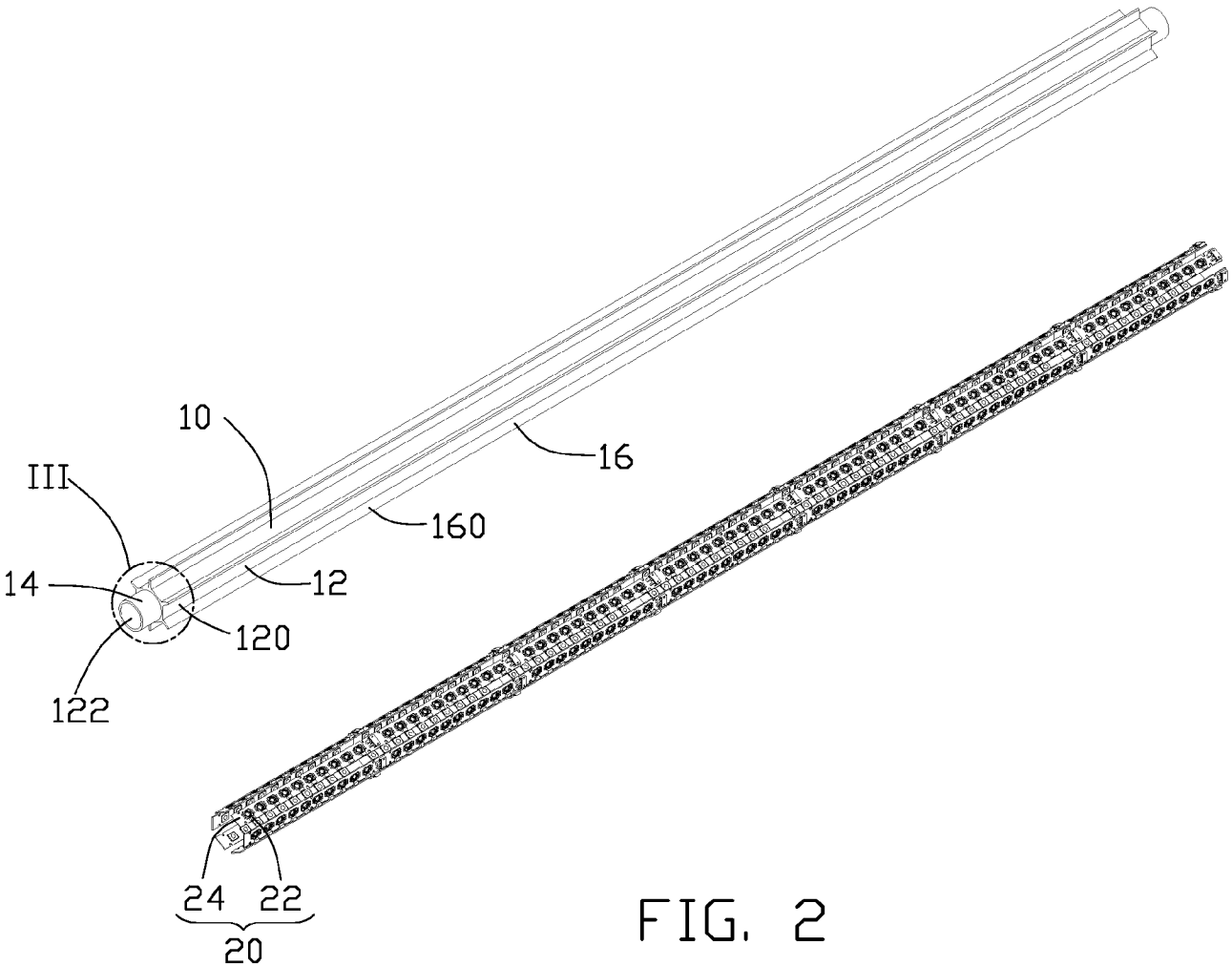
FIG. 2 is an exploded view of FIG. 1.
Figure 3:
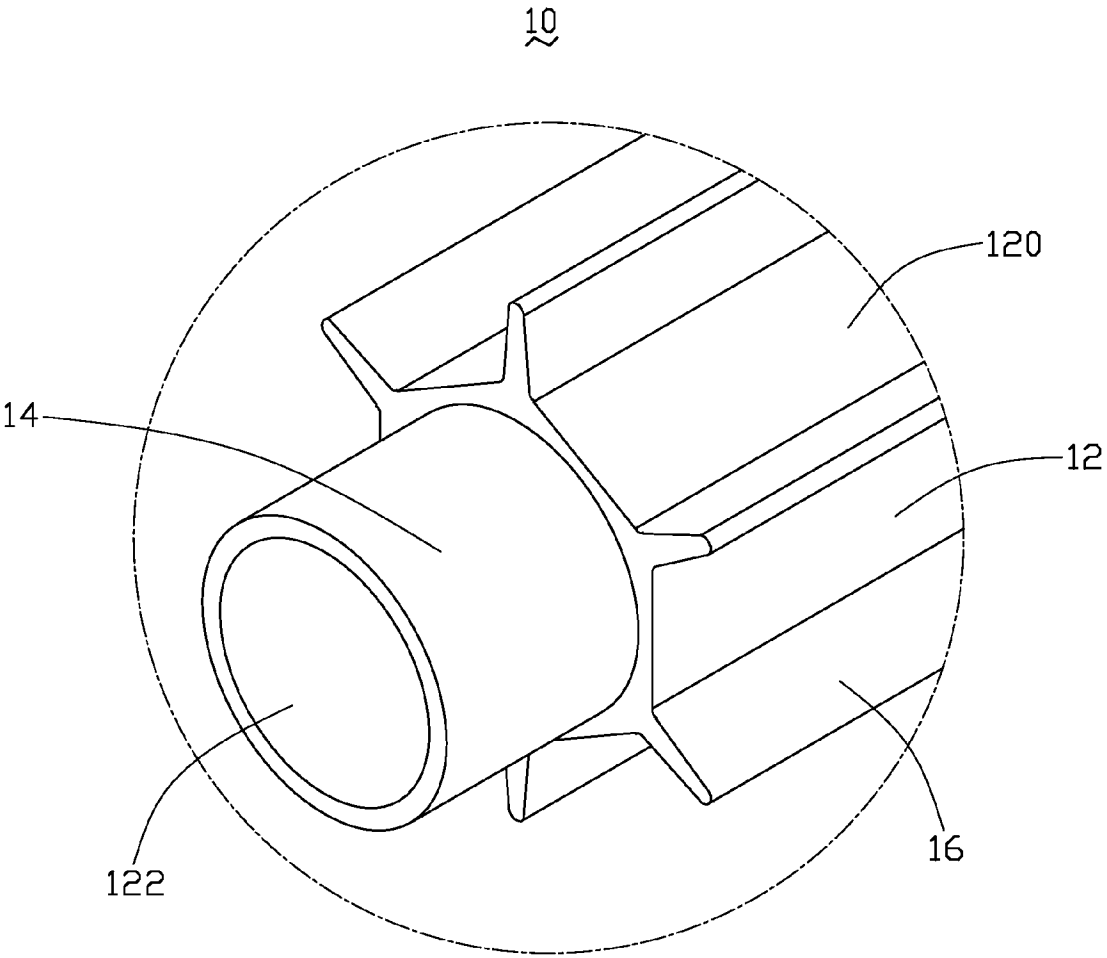
FIG. 3 is an enlarged view of a part of a heat sink of FIG. 2.
Figure 4:
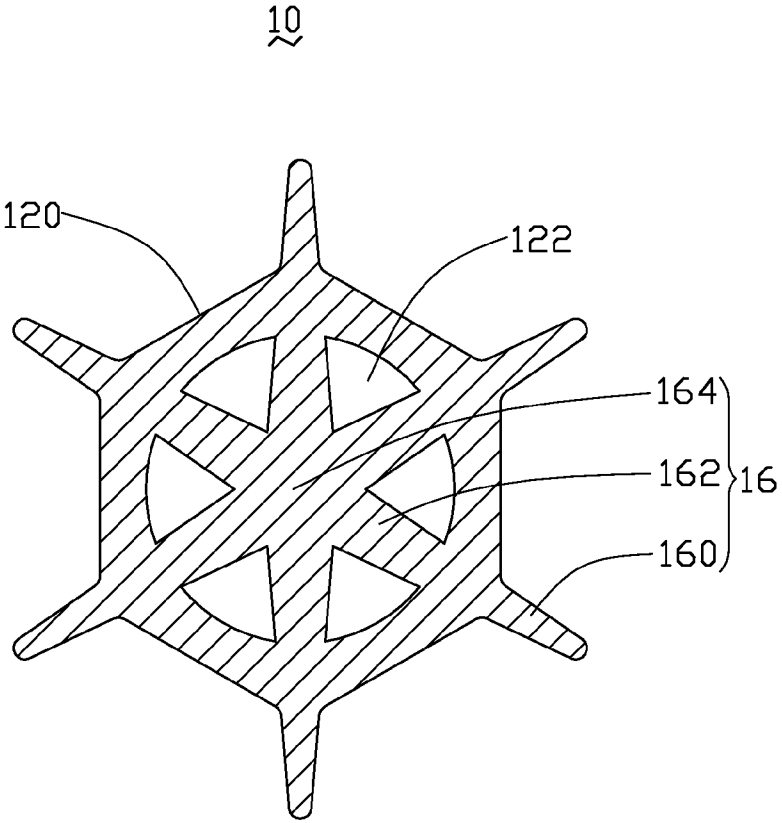
FIG. 4 is a view of a cross section of the heat sink of FIG. 1.

Referring to FIGS. 2-4, the heat sink 10 is made as a single piece from a metal such as aluminum, copper or an alloy of the two. The heat sink 10 comprises a hollow hexagonal prism 12, which has six elongated and identical sidewalls 120. The hexagonal prism 12 defines a circular through hole 122 at a center thereof, extending from a lateral side to an opposite lateral side of the heat sink 10, whereby the hexagonal prism 12 has a cylindrical inner face. A pair of annular connections 14 project outwardly from the two opposite lateral sides of the heat sink 10 with a central axis of each connection 14 in line with a central axis of the inner face of the hexagonal prism 12. Each connection 14 has an inner face coupling with the inner face of the hexagonal prism 12 for allowing the through hole 122 extending therethrough in a manner such that a diameter of the inner face of each connection 14 is essentially identical to that of the inner face of the hexagonal prism 12, and an diameter of an outer face of each connection 14 is less than that of the periphery of the hexagonal prism 12. The connections 14 are used for engaging with lamp supports (not shown), thus attaching the LED lamp to the lamp supports. Six fins 16 with inward increasing thicknesses are formed at junctions of adjacent sidewalls 120 of the hexagonal prism 12 from the lateral side to the opposite lateral side of the heat sink 10, wherein each of the fins 16 has an internal portion 162 extending inwardly from the inner face of the hexagonal prism 12, and an external portion 160 opposing to the internal portion 162 and extending outwardly from a corresponding junction of the adjacent sidewalls 120 of the hexagonal prism 12 in a radial manner. The external portions 160 of the fins 16 are evenly spaced from each other with an angle of 60 degrees defined between two adjacent external portions 160. The external portions 160 of the fins 16 and corresponding sidewalls 120 of the hexagonal prism 12 cooperate to define six elongated, recessed regions (not labeled) around the periphery of the heat sink 10. Extremities of the internal portions 162 opposing to corresponding external portions 160 of the fins 16 connect with each other at a centre of the through hole 122 of the heat sink 10 to form a joint 164 of the fins 16, whereby the internal portions 162 define a "*"-shaped cross section. The internal portions 162 thereby not only enhance a heat dissipating area of the heat sink 10, but also reinforce the heat sink 10. The internal portions 162 of the fins 16 divide the through hole 122 of the heat sink 10 into six channels, which are defined between adjacent internal portions 162 of the fins 16 for providing passages of airflow through the heat sink 10. The channels are spaced from each other and distributed evenly relative to the joint 164 of the fins 16.

Referring to FIG. 2 again, each LED module 20 comprises an elongated printed circuit board 24 having a length essentially identical to that of the hexagonal prism 12, and a plurality of LEDs 22 mounted on a top side of the printed circuit board 24 in a line, which extends along a lengthwise direction of the printed circuit board 24. The LED modules 20 are attached to the heat sink 10 with bottom sides of the printed circuit boards 24 thermally contacting corresponding sidewalls 120 of the hexagonal prism 12, wherein each LED module 20 is located in a corresponding recessed region between two external portions 160 of two adjacent fins 16 of the heat sink 10. The LED modules 20 surround the hexagonal prism 12 and are distributed evenly with respective to a central axis, i.e., the joint 164 of the heat sink 10.

Also referring to FIG. 4, in use, as the LEDs 22 are activated, heat generated by the LEDs 22 is conducted to the heat sink 10 via the printed circuit board 24. Due to the fins 16 of the heat sink 10, the heat sink 10 has a large area contacting ambient air, thus allowing the heat sink 10 to exchange heat efficiently with an ambient air. A part of the heat is dispersed to the ambient air via the external portions 160 of the fins 16 and the connections 14. Remaining heat is conveyed to the ambient air in the heat sink 10 via the inner face of the heat sink 10 and the internal portions 162 of the fins 16. The ambient air is heated and flows upwardly away from the heat sink 10, thereby bringing a large mount of heat away from the heat sink 10. Thus the LED lamp has an improved heat dissipating configuration for preventing the LEDs 22 of the LED lamp from overheating, while the LED lamp can have a compact structure.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a hollow prism-shaped heat sink with a through hole defined therein from a lateral side to an opposite lateral side thereof;

a plurality of LED modules mounted on a periphery of the heat sink; and a plurality of fins attached to the heat sink, the fins having external portions outside the heat sink, and internal portions in the through hole of the heat sink in a manner such that at least two fins have the external portions thereof spaced from each other, and the internal portions thereof connecting with each other, thus increasing a heat dissipating area of the heat sink and reinforcing the heat sink;

wherein a pair of annular connections project outwardly from the two opposite lateral sides of the heat sink in such a manner that each of the pair of annular connections has an interior diameter essentially identical to an interior diameter of the heat sink, and an exterior diameter less than an exterior diameter of the heat sink.

2. The LED lamp of claim 1, wherein the heat sink comprises a plurality of outer sidewalls with the LED modules mounted on corresponding outer sidewalls along a lengthwise direction of the heat sink.

3. The LED lamp of claim 2, wherein the external portions of the at least two fins extend outwardly from junctions of corresponding adjacent sidewalls, respectively, with at least one of the LED modules located between the at least two fins.

4. The LED lamp of claim 1, wherein the heat sink has a cylindrical inner face to enclose the through hole of the heat sink.

5. The LED lamp of claim 4, wherein the internal portions of the at least two fins extend inwardly from the inner face of the heat sink opposing to corresponding external portions of the at least two fins.

6. The LED lamp of claim 5, wherein extremities of the internal portions of the least two fins connect with each other to form a joint at a centre of the through hole of the heat sink.

7. The LED lamp of claim 6, wherein a plurality of channels is defined between adjacent internal portions of the fins and the inner face of the heat sink for providing passages of airflow.

8. The LED lamp of claim 7, wherein the channels are spaced from each other and distributed evenly with respective to the joint of the fins.

9. The LED lamp of claim 1, wherein the fins extend along the lengthwise direction of the heat sink from the lateral side to the opposite lateral side of the heat sink and have inward increasing thicknesses.

10. A heat dissipation device for dissipating heat generated by LED modules, comprising:

a hollow prism-shaped heat sink with a through hole define therein from a lateral side to an opposite lateral side thereof, the heat sink comprising a plurality of outer sidewalls adapted for mounting the LED modules thereon, and an inner face enclosing the through hole of the heat sink; and a plurality of fins attached to the heat sink, at least two fins having external portions extending outwardly from the sidewalls of the heat sink, and internal portions extending inwardly from the inner face of the heat sink, wherein the external portions of the at least two fins are spaced from each other, and the internal portions of the heat sink connect with each other to form a joint in the through hole of the heat sink, thus reinforcing the heat sink; and wherein a pair of annular connections are formed outwardly from the two opposite lateral sides of the heat sink and opposing to each other, each annular connections having an inner diameter identical to an inner diameter of the heat sink, and an outer diameter less than an outer diameter of the heat sink.

11. The heat dissipation device of claim 10, wherein the external portions of the at least two fins are located at junctions of corresponding sidewalls of the heat sink.

12. The heat dissipation device of claim 10, wherein the internal portions of the fins divide the through hole of the heat sink into a plurality of channels, each of the channels is located between two adjacent fins and a corresponding sidewall of the heat sink.

13. The heat dissipation device of claim 12, wherein extremities of the internal portions of the at least two fins connect with each other at a centre of the heat sink for allowing the channels and the fins to be distributed evenly with respective to the joint.

14. The heat dissipation device of claim 10, wherein the fins extend from the lateral side to the opposite lateral side of the heat sink in a manner such that the fins have outward descending thicknesses.

15. The heat dissipation device of claim 10, wherein the through hole extends through the pair of annular connections.

16. An LED lamp comprising:

a heat sink having a tubular wall, a plurality of first fins extending from a center of the tubular wall to an inner periphery of the tubular wall and a plurality of second fins extending outwardly from an outer periphery of the tubular wall; and a plurality of LED modules each having a printed circuit board and a plurality of LEDs mounted on the printed circuit board;

wherein each of the LED modules is mounted on the outer periphery of the tubular wall and between two neighboring second fins; and wherein the heat sink comprises two connectors located at two opposite sides of the tubular wall, respectively, each connector having an inner diameter identical to an inter diameter of the tubular wall, and an outer diameter less than an outer diameter of the tubular wall.

* * * * *